US012534875B2

(12) United States Patent
Hino et al.

(10) Patent No.: US 12,534,875 B2
(45) Date of Patent: Jan. 27, 2026

(54) CONTROL SYSTEM, CONTROL METHOD, AND CONTROL PROGRAM

(71) Applicant: KOMATSU LTD., Tokyo (JP)

(72) Inventors: Shinya Hino, Tokyo (JP); Kazuki Takehara, Tokyo (JP)

(73) Assignee: Komatsu Ltd., Tokyo (JP)

( * ) Notice: Subject to any disclaimer, the term of this patent is extended or adjusted under 35 U.S.C. 154(b) by 88 days.

(21) Appl. No.: 18/683,751

(22) PCT Filed: Aug. 30, 2022

(86) PCT No.: PCT/JP2022/032564
§ 371 (c)(1),
(2) Date: Feb. 14, 2024

(87) PCT Pub. No.: WO2023/032970
PCT Pub. Date: Mar. 9, 2023

(65) Prior Publication Data

US 2024/0368856 A1 Nov. 7, 2024

(30) Foreign Application Priority Data

Aug. 31, 2021 (JP) ..... 2021-141532

(51) Int. Cl.
*E02F 9/20* (2006.01)
*E02F 9/12* (2006.01)

(52) U.S. Cl.
CPC ..... *E02F 9/2033* (2013.01); *E02F 9/123* (2013.01)

(58) Field of Classification Search
CPC ..... E02F 9/20; E02F 9/2033; E02F 9/123
USPC ..... 701/50
See application file for complete search history.

(56) References Cited

U.S. PATENT DOCUMENTS

| | | | | |
|---|---|---|---|---|
| 11,149,406 | B2 * | 10/2021 | Doi | E02F 9/24 |
| 11,572,671 | B2 * | 2/2023 | Viergutz | E02F 3/435 |
| 11,891,775 | B2 * | 2/2024 | Chiba | E02F 9/2285 |
| 12,024,851 | B2 * | 7/2024 | Konda | E02F 3/32 |
| 2022/0018095 | A1 | 1/2022 | Doi | |
| 2023/0366174 | A1 * | 11/2023 | Nishikawa | E02F 3/435 |

FOREIGN PATENT DOCUMENTS

| | | | |
|---|---|---|---|
| EP | 3779054 | A1 | 2/2021 |
| EP | 3868963 | A1 | 8/2021 |
| WO | WO 2019/189030 | A1 | 10/2019 |
| WO | WO 2020/080538 | A1 | 4/2020 |
| WO | WO 2020/170687 | A1 | 8/2020 |

* cited by examiner

*Primary Examiner* — Andrew Joseph Rudy
(74) *Attorney, Agent, or Firm* — Fish & Richardson P.C.

(57) ABSTRACT

A generation unit generates a virtual wall that is defined by a plane on a vehicle body coordinate system of which origin is a representative point of a swing body. A rotation conversion unit rotationally converts the virtual wall around the origin of the vehicle body coordinate system in association with a swing of the swing body. A position specifying unit specifies a position of an outer shell of a work machine in the vehicle body coordinate system. An intervention control unit controls the work machine such that the outer shell does not come into contact with the virtual wall.

7 Claims, 11 Drawing Sheets

CONTROL SYSTEM, CONTROL METHOD, AND CONTROL PROGRAM

CROSS-REFERENCE TO RELATED APPLICATIONS

This application is a National Stage application under 35 U.S.C. § 371 of International Application No. PCT/JP2022/032564, filed on Aug. 30, 2022, which claims priority to Japanese Patent Application No. 2021-141532, filed on Aug. 31, 2021. The contents of the prior applications are incorporated herein in their entirety.

TECHNICAL FIELD

The present disclosure relates to a control system, a control method, and a control program.

BACKGROUND ART

A technique of setting a virtual wall in a space to limit an operation range of a work machine is known. A control device of the work machine can control the work machine not to exceed the virtual wall by limiting an operating amount of an actuator of the work machine according to a distance between the virtual wall and the work machine.

CITATION LIST

Patent Document

Patent Document 1

PCT International Publication No. WO 2019/189030

SUMMARY OF INVENTION

Technical Problem

By the way, when a virtual wall is set on a work site, the position of the virtual wall is represented in a global coordinate system. Therefore, when a work machine is desired to be controlled based on the virtual wall, the work machine needs to have a configuration such as GNSS for recognizing the position of the global coordinate system. However, the work machine does not necessarily have a configuration to acquire the position information by the GNSS or the like.

On the other hand, when the virtual wall is set in a vehicle body coordinate system with a swing body as a reference, the virtual wall set in the vehicle body coordinate system follows the swing of the swing body, and thus is configured in an annular shape with the work machine at the center. Therefore, it is difficult to set the virtual wall of a plane along a building or the like in the vehicle body coordinate system.

An object of the present disclosure is to provide a control device, a control method, and a control program capable of limiting an operation of a work machine by a virtual wall of a plane without referring to a global coordinate system.

Solution to Problem

According to a first aspect of the present invention, a control system controls a work machine including a swing body configured to swing. The control system includes a processor. The processor generates a virtual wall that is defined by a plane on a vehicle body coordinate system of which origin is a representative point of the swing body. The processor rotationally converts the virtual wall around the origin of the vehicle body coordinate system in association with a swing of the swing body. The processor specifies a position of an outer shell of the work machine in the vehicle body coordinate system. The processor controls the work machine such that the outer shell does not come into contact with the virtual wall.

According to a second aspect of the present invention, a control method of a work machine including a swing body configured to swing, includes a generation step, a conversion step, a specifying step, and a control step. The generation step generates a virtual wall that is defined by a plane on a vehicle body coordinate system of which origin is a representative point of the swing body. The conversion step rotationally converts the virtual wall around the origin of the vehicle body coordinate system in association with a swing of the swing body. The specifying step specifies a position of an outer shell of the work machine in the vehicle body coordinate system. The control step controls the work machine such that the outer shell does not come into contact with the virtual wall.

According to a third aspect of the present invention, a control program executed by a computer that controls a work machine including a swing body configured to swing, includes a generation step, a conversion step, a specifying step, and a control step. The generation step generates a virtual wall that is defined by a plane on a vehicle body coordinate system of which origin is a representative point of the swing body. The conversion step rotationally converts the virtual wall around the origin of the vehicle body coordinate system in association with a swing of the swing body. The specifying step specifies a position of an outer shell of the work machine in the vehicle body coordinate system. The control step controls the work machine such that the outer shell does not come into contact with the virtual wall.

Advantageous Effects of Invention

According to at least one of the above aspects, an operation of the work machine can be limited by a virtual wall of a plane without referring to a global coordinate system.

DESCRIPTION OF EMBODIMENTS

First Embodiment

Configuration of Work Machine

Hereinafter, an embodiment of the present invention is described in detail with reference to the drawings.

Figure 1:
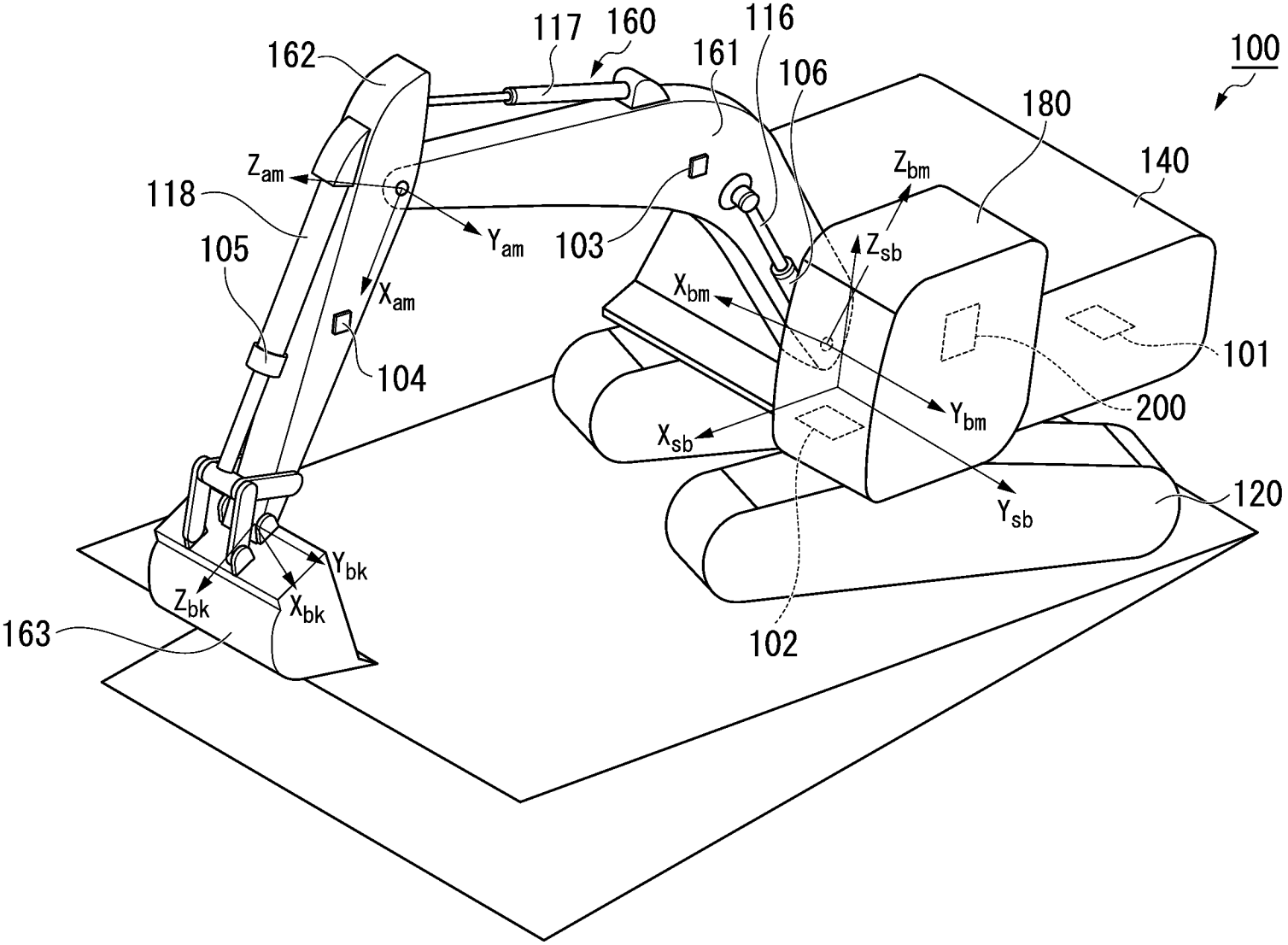
FIG. 1 is a schematic diagram showing a configuration of a work machine according to a first embodiment.

FIG. 1 is a schematic diagram showing a configuration of a work machine 100 according to the first embodiment. The work machine 100 according to the first embodiment is, for example, a hydraulic excavator. The work machine 100 includes an undercarriage 120, a swing body 140, work equipment 160, a cab 180, and a control device 200. The work machine 100 according to the first embodiment generates a planar virtual wall by an operation of the operator, and is controlled such that the work machine 100 does not come into contact with the virtual wall. As a result, the operator can operate the work machine 100 not to enter the entry prohibition area.

The undercarriage 120 travellably supports the work machine 100. The undercarriage 120 is, for example, a pair of left and right endless tracks.

The swing body 140 is supported by the undercarriage 120 to be swingable around a swing center.

The work equipment 160 is operably supported by the swing body 140. The work equipment 160 is driven by hydraulic pressure. The work equipment 160 includes a boom 161, an arm 162, and a bucket 163 that is a work implement. The proximal end portion of the boom 161 is rotatably attached to the swing body 140. The proximal end portion of the arm 162 is rotatably attached to the distal end portion of the boom 161. The bucket 163 is rotatably attached to the distal end portion of the arm 162. Here, the portion of the swing body 140 to which the work equipment 160 is attached is referred to as a front portion. In addition, in the swing body 140, a portion on an opposite side, a portion on a left side, and a portion on a right side with respect to the front portion are referred to as a rear portion, a left portion, and a right portion.

The cab 180 is provided at the front portion of the swing body 140. An operation device 141 for an operator to operate the work machine 100, and a monitor device 142 that is a man-machine interface of the control device 200 are provided in the cab 180. The monitor device 142 is realized by, for example, a computer including a touch panel.

The control device 200 controls the undercarriage 120, the swing body 140, and the work equipment 160 based on an operation of the operation device by the operator. The control device 200 is provided, for example, inside the cab 180.

Drive System of Work Machine 100

Figure 2:
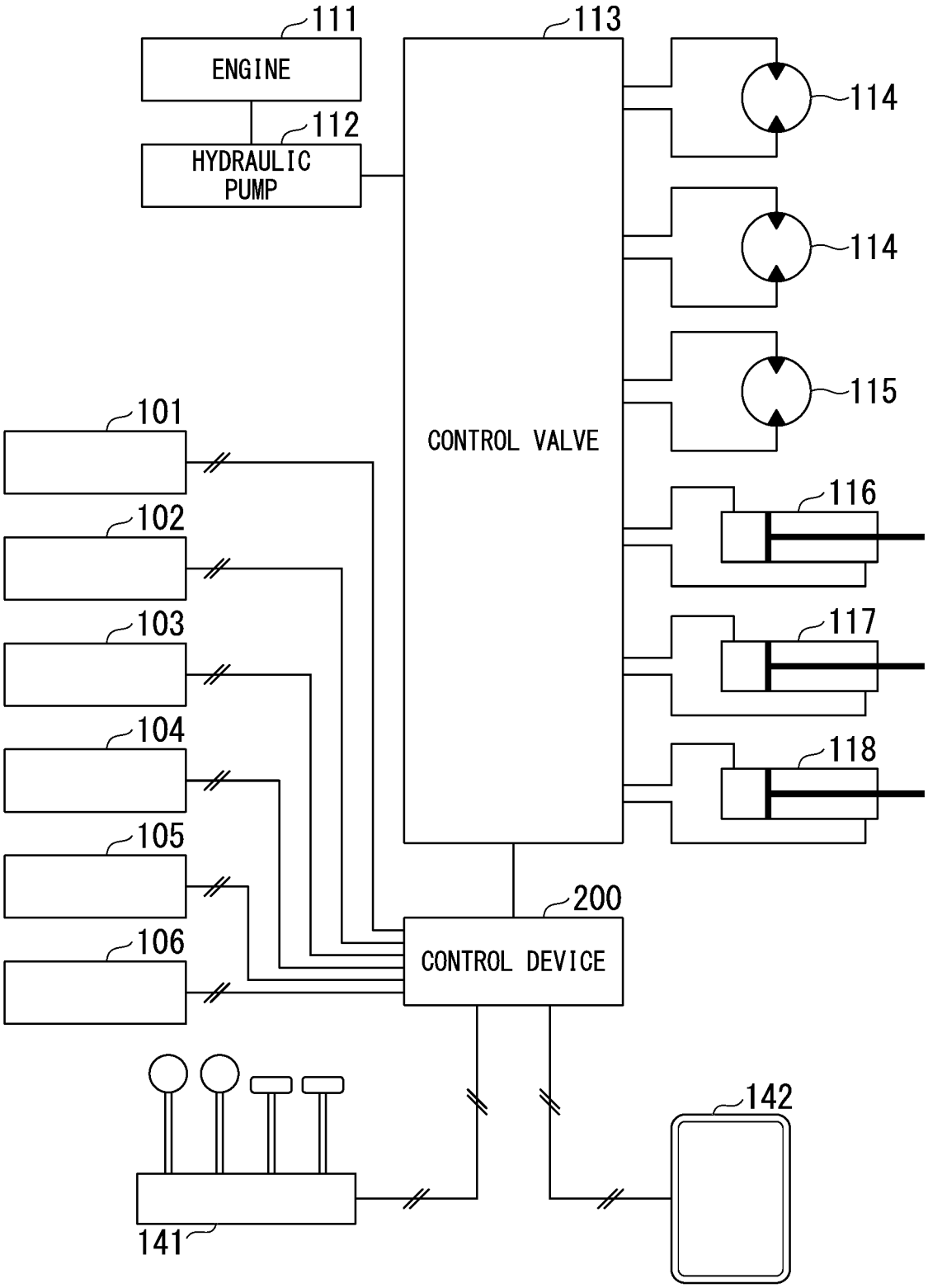
FIG. 2 is a diagram showing a drive system of the work machine according to the first embodiment.

FIG. 2 is a diagram showing a drive system of the work machine 100 according to the first embodiment.

The work machine 100 includes a plurality of actuators for driving the work machine 100. Specifically, the work machine 100 includes an engine 111, a hydraulic pump 112, a control valve 113, a pair of traveling motors 114, a swing motor 115, a boom cylinder 116, an arm cylinder 117, and a bucket cylinder 118.

The engine 111 is a prime mover that drives the hydraulic pump 112.

The hydraulic pump 112 is driven by the engine 111 and supplies hydraulic oil to the traveling motor 114, the swing motor 115, the boom cylinder 116, the arm cylinder 117, and the bucket cylinder 118 via the control valve 113.

The control valve 113 controls the flow rate of the hydraulic oil to be supplied from the hydraulic pump 112 to the traveling motor 114, the swing motor 115, the boom cylinder 116, the arm cylinder 117, and the bucket cylinder 118.

The traveling motor 114 is driven by the hydraulic oil supplied from the hydraulic pump 112 and drives the undercarriage 120.

The swing motor 115 is driven by the hydraulic oil supplied from the hydraulic pump 112 and causes the swing body 140 to swing with respect to the undercarriage 120.

The boom cylinder 116 is a hydraulic cylinder that drives the boom 161. The proximal end portion of the boom cylinder 116 is attached to the swing body 140. The distal end portion of the boom cylinder 116 is attached to the boom 161.

The arm cylinder 117 is a hydraulic cylinder to drive the arm 162. The proximal end portion of the arm cylinder 117 is attached to the boom 161. The distal end portion of the arm cylinder 117 is attached to the arm 162.

The bucket cylinder 118 is a hydraulic cylinder to drive the bucket 163. The proximal end portion of the bucket cylinder 118 is attached to the arm 162. The distal end portion of the bucket cylinder 118 is attached to the bucket 163.

Measurement System of Work machine 100

The work machine 100 includes a plurality of sensors to measure the posture and position of the work machine 100. Specifically, the work machine 100 includes an inclination measurer 101, a swing angle sensor 102, a boom angle sensor 103, an arm angle sensor 104, a bucket angle sensor 105, and a payload meter 106.

The inclination measurer 101 measures the posture of the swing body 140. The inclination measurer 101 measures the inclination (for example, roll angle, pitch angle, and yaw angle) of the swing body 140 with respect to a horizontal plane. As the inclination measurer 101, an inertial measurement unit (IMU) is an exemplary example. In this case, the inclination measurer 101 measures the acceleration and angular speed of the swing body 140 and calculates the inclination of the swing body 140 with respect to the horizontal plane based on the measurement result. The inclination measurer 101 is installed, for example, below the cab 180. The inclination measurer 101 outputs the posture data of the swing body 140, which is a measurement value, to the control device 200.

The swing angle sensor 102 measures the swing angle of the swing body 140 with respect to the undercarriage 120. The measurement value of the swing angle sensor 102 indicates zero, for example, when the directions of the undercarriage 120 and the swing body 140 match each other. The swing angle sensor 102 is installed, for example, at the swing center of the swing body 140. The swing angle sensor 102 outputs swing angle data, which is the measurement value, to the control device 200.

The boom angle sensor 103 measures a boom angle, which is the rotation angle of the boom 161 with respect to the swing body 140. The boom angle sensor 103 may be an IMU attached to the boom 161. In this case, the boom angle sensor 103 measures the boom angle based on the inclination of the boom 161 with respect to the horizontal plane and the inclination of the swing body measured by the inclination measurer 101. The measurement value of the boom angle sensor 103 indicates zero, for example, when the direction of a straight line passing through the proximal end and the distal end of the boom 161 coincides with the front to rear direction of the swing body 140. Incidentally, the boom angle sensor 103 according to another embodiment may be a stroke sensor attached to the boom cylinder 116. In addition, the boom angle sensor 103 according to another embodiment may be a rotation sensor provided on a pin that connects the swing body 140 and the boom 161. The boom angle sensor 103 outputs boom angle data, which is the measurement value, to the control device 200.

The arm angle sensor 104 measures an arm angle, which is the rotation angle of the arm 162 with respect to the boom 161. The arm angle sensor 104 may be an IMU attached to the arm 162. In this case, the arm angle sensor 104 measures the arm angle based on the inclination of the arm 162 with respect to the horizontal plane and the boom angle measured by the boom angle sensor 103. The measurement value of the arm angle sensor 104 indicates zero, for example, when the direction of the straight line passing through the proximal end and the distal end of the arm 162 coincides with the direction of the straight line passing through the proximal end and the distal end of the boom 161. Incidentally, the arm angle sensor 104 according to another embodiment may perform angle calculation by attaching a stroke sensor to the arm cylinder 117. In addition, the arm angle sensor 104 according to another embodiment may be a rotation sensor provided on a pin that connects the boom 161 and the arm 162. The arm angle sensor 104 outputs arm angle data, which is the measurement value, to the control device 200.

The bucket angle sensor 105 measures a bucket angle, which is the rotation angle of the bucket 163 with respect to the arm 162. The bucket angle sensor 105 may be a stroke sensor provided in the bucket cylinder 118 to drive the bucket 163. In this case, the bucket angle sensor 105 measures the bucket angle based on the stroke amount of the bucket cylinder. The measurement value of the bucket angle sensor 105 indicates zero, for example, when the direction of the straight line passing through the proximal end and the teeth of the bucket 163 coincides with the direction of the straight line passing through the proximal end and the distal end of the arm 162. Incidentally, the bucket angle sensor 105 according to another embodiment may be a rotation sensor provided on a pin that connects the arm 162 and the bucket 163. In addition, the bucket angle sensor 105 according to another embodiment may be an IMU attached to the bucket 163. The bucket angle sensor 105 outputs bucket angle data, which is the measurement value, to the control device 200.

The payload meter 106 measures the weight of the load held in the bucket 163. The payload meter 106 measures, for example, a bottom pressure of the cylinder of the boom 161 and converts the bottom pressure into the weight of the load. In addition, for example, the payload meter 106 may be a load cell. The payload meter 106 outputs the weight data of the load, which is the measurement value, to the control device 200.

Configuration of Control Device 200

Figure 3:
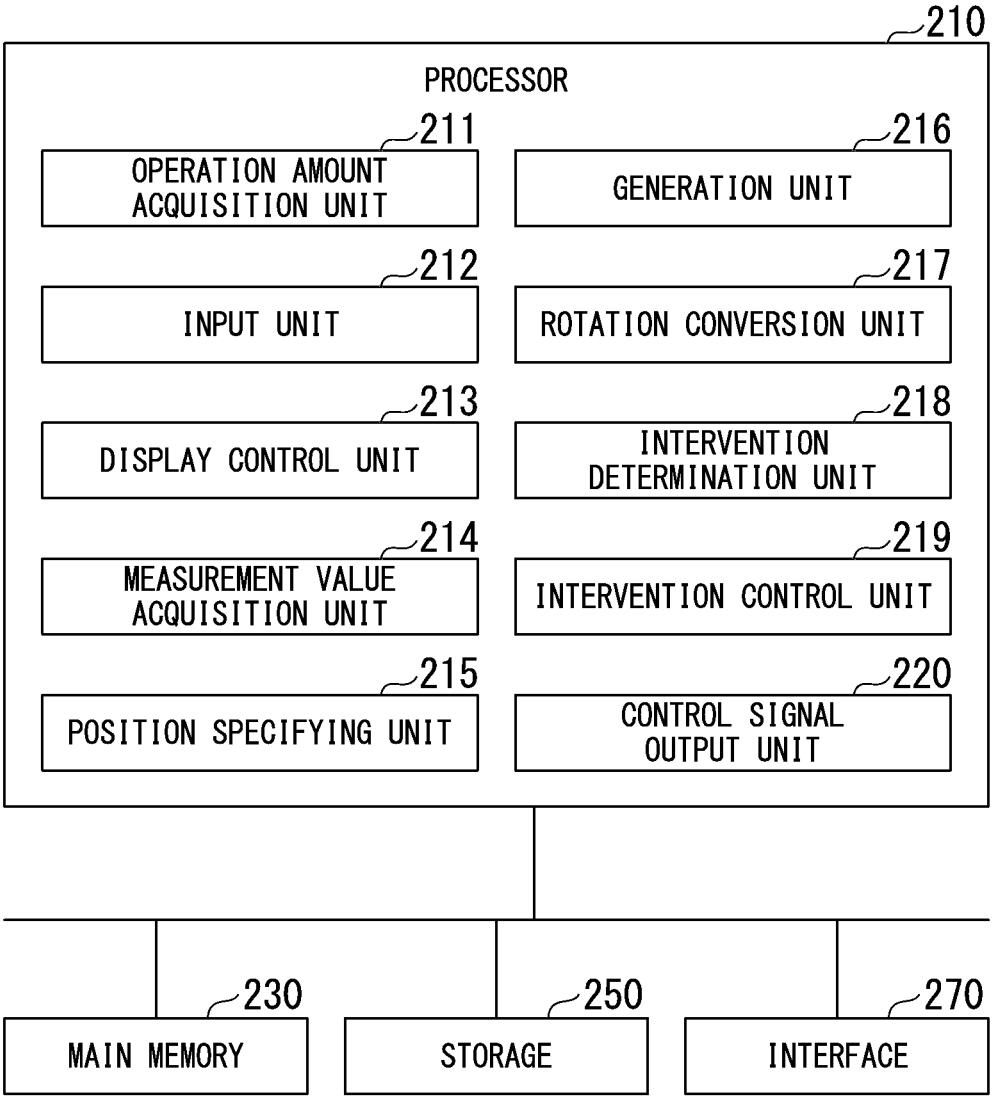
FIG. 3 is a schematic block diagram showing a configuration of a control device according to the first embodiment.

FIG. 3 is a schematic block diagram showing a configuration of the control device 200 according to the first embodiment.

The control device 200 is a computer including a processor 210, a main memory 230, a storage 250, and an interface 270. The control device 200 is an example of a control system. The control device 200 receives measurement values from the inclination measurer 101, the swing angle sensor 102, the boom angle sensor 103, the arm angle sensor 104, the bucket angle sensor 105, and the payload meter 106.

The storage 250 is a non-transitory, tangible storage medium. As the storage 250, magnetic disks, optical disks, magneto-optical disks, semiconductor memories, or the like are exemplary examples. The storage 250 may be an internal medium that is directly connected to a bus of the control device 200 or may be an external medium connected to the control device 200 via the interface 270 or a communication line. The storage 250 stores a control program to control the work machine 100.

The control program may realize some of functions to be exhibited by the control device 200. For example, the control program may function in combination with another program already stored in the storage 250 or in combination with another program implemented in another device. Incidentally, in another embodiment, the control device 200 may include a custom large scale integrated circuit (LSI) such as a programmable logic device (PLD) in addition to the above configuration or instead of the above configuration. Exemplary examples of the PLD include a programmable array logic (PAL), a generic array logic (GAL), a complex programmable logic device (CPLD), and a field programmable gate array (FPGA). In this case, part or all of the functions realized by the processor may be realized by the integrated circuit.

In the storage 250, geometry data representing dimensions and positions of the centers of gravity of the swing body 140, the boom 161, the arm 162, and the bucket 163 is recorded. The geometry data is data representing the position of an object in a predetermined coordinate system.

Software Configuration

By executing the control program, the processor 210 includes an operation amount acquisition unit 211, an input unit 212, a display control unit 213, a measurement value acquisition unit 214, a position specifying unit 215, a generation unit 216, a rotation conversion unit 217, an intervention determination unit 218, an intervention control unit 219, and a control signal output unit 220.

The operation amount acquisition unit 211 acquires an operation signal indicating an operation amount of each actuator from the operation device 141.

The input unit 212 receives an operation input by an operator from the monitor device 142.

The display control unit 213 outputs screen data to be displayed on the monitor device 142 to the monitor device 142.

The measurement value acquisition unit 214 acquires measurement values from the inclination measurer 101, the swing angle sensor 102, the boom angle sensor 103, the arm angle sensor 104, the bucket angle sensor 105, and the payload meter 106.

The position specifying unit 215 specifies the position of an outer shell of the work machine 100 in the vehicle body coordinate system. The outer shell of the work machine 100 is an outer shape of the work machine 100. The outer shell of the work machine 100 is defined by, for example, shapes that form outer shapes of the swing body 140 and the work equipment 160. Specifically, the position specifying unit 215 specifies the position of a plurality of points on the outer shell of the work machine 100 in the vehicle body coordinate system based on various measurement values acquired by the measurement value acquisition unit 214 and the geometry data recorded in the storage 250. The plurality of points of the outer shell specified by the position specifying unit 215 include points of the teeth of the bucket 163, the end (arm top) of the arm 162 on the side of the bucket 163, the end (arm bottom) of the arm 162 on the side of the boom 161, and the rear portion of the counterweight of the swing body 140. The vehicle body coordinate system is a Cartesian coordinate system of which origin is a representative point of the swing body 140 (for example, a point passing through the swing center). The calculation of the position specifying unit 215 will be described later. Incidentally, the point specified by the position specifying unit 215 is not limited thereto.

When the input unit 212 receives a generation instruction of the virtual wall from the operator, the generation unit 216 calculates parameters of the virtual wall based on the position of the teeth of the bucket 163 specified by the position specifying unit 215. The generation unit 216 records the generated parameter of the virtual wall in the vehicle body coordinate system in the main memory 230.

Figure 4:
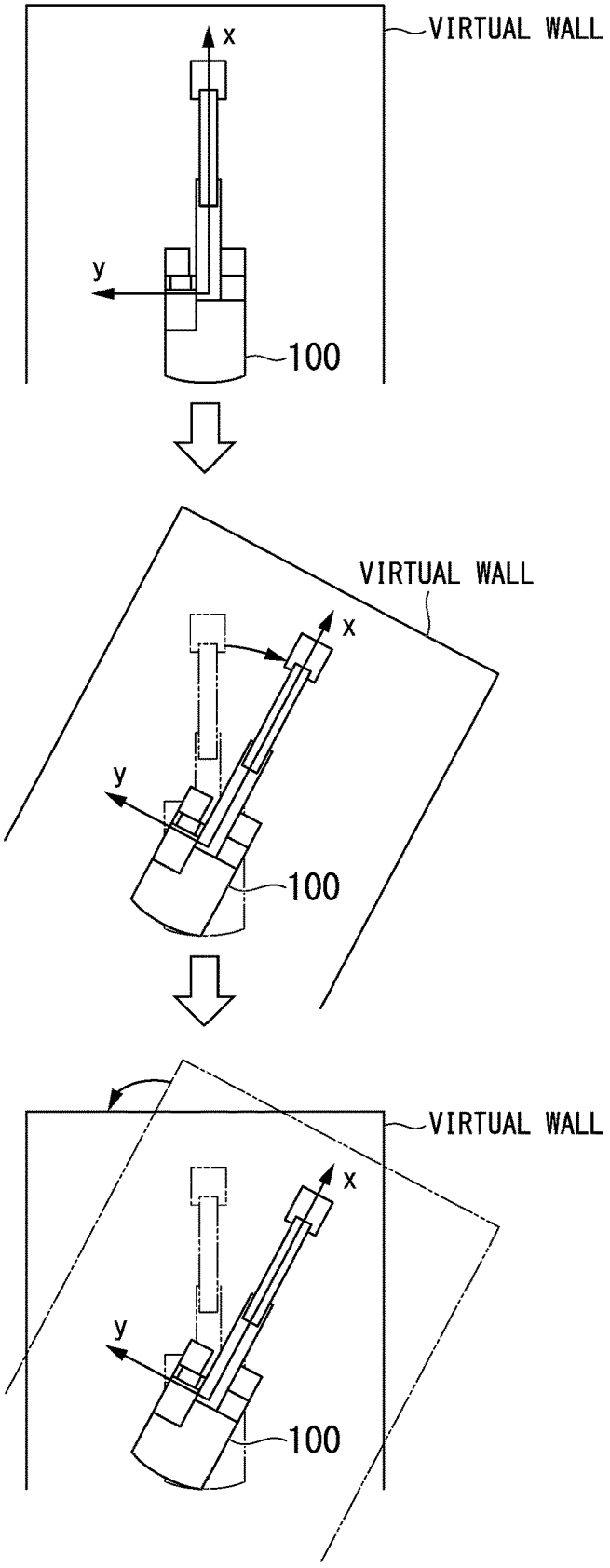
FIG. 4 is a diagram showing an example of resetting a virtual wall in accordance with a swing of a swing body in the first embodiment.

The rotation conversion unit 217 updates the parameter of the virtual wall stored in the main memory 230 in association with the swing of the swing body 140. Specifically, the rotation conversion unit 217 rotationally converts the parameter of the virtual wall about the origin of the vehicle body coordinate system by the amount of change in the pitch angle, the roll angle, and the yaw angle that are measured by the inclination measurer 101. FIG. 4 is a diagram showing an example of resetting the virtual wall in accordance with a swing of a swing body in the first embodiment. For example, as represented in FIG. 4, in a case where the swing body 140 swings after the virtual wall is set, the rotation conversion unit 217 calculates the amount of change in the roll angle, the pitch angle, and the yaw angle caused by the swing of the swing body 140 by referring to the measurement value of the inclination measurer 101 acquired by the measurement value acquisition unit 214, and rotationally converts the parameter of the virtual wall about the origin of the vehicle body coordinate system. As a result, the rotation conversion unit 217 can cancel the rotation of the virtual wall caused by the swing of the swing body 140.

The intervention determination unit 218 determines whether or not to limit the swing speed of the swing body 140 or the speed of the work equipment 160 based on the positional relationship between the plurality of points of the outer shell specified by the position specifying unit 215 and the virtual wall. Hereinafter, limiting the speed of the swing body 140 or the work equipment 160 by the control device 200 is also referred to as intervention control. Specifically, the intervention determination unit 218 obtains a minimum swing angle until at least one of a plurality of points of the outer shell and the virtual wall come into contact with each other, and determines to perform intervention control on the swing body 140 in a case where the minimum swing angle is equal to or less than a predetermined angle. In addition, the intervention determination unit 218 obtains a minimum distance between the virtual wall and the work equipment 160, and determines to perform intervention control on the work equipment 160 in a case where the minimum distance is equal to or less than a predetermined distance.

When the intervention determination unit 218 determines to perform the intervention control, the intervention control unit 219 controls the operation amount of the intervention target in the operation amounts acquired by the operation amount acquisition unit 211.

The control signal output unit 220 outputs the operation amount acquired by the operation amount acquisition unit 211 or the operation amount controlled by the intervention determination unit 218 to the control valve 113.

Calculation of Position Specifying Unit 215

Here, a method for specifying the position of the point on the outer shell of the work machine 100 by the position specifying unit 215 will be described. The position specifying unit 215 specifies the position of the point on the outer shell based on the various measurement values acquired by the measurement value acquisition unit 214 and the geometry data recorded in the storage 250. In the storage 250, geometry data representing dimensions and positions of the centers of gravity of the swing body 140, the boom 161, the arm 162, and the bucket 163 is recorded.

The geometry data of the swing body 140 indicates the positions ($x_{bm}$, $y_{bm}$, and $z_{bm}$) of the pin that supports the boom 161 of the swing body 140 and the positions ($x_{sp}$, $y_{sp}$, and $z_{sp}$) of the point of the outer shell of the swing body 140 in the vehicle body coordinate system that is a local coordinate system. Exemplary examples of the point of the outer shell of the swing body 140 include a point having a high possibility of coming into contact with the wall surface due to a swing, such as a protrusion point of the counterweight, for example. The vehicle body coordinate system is a coordinate system configured by an $X_{sb}$ axis extending in a front to rear direction, a $Y_{sb}$ axis extending in a right to left direction, and a $Z_{sb}$ axis extending in an up and down direction with the swing center of the swing body 140 as a reference. Incidentally, the up and down direction of the swing body 140 does not necessarily coincide with the vertical direction.

The geometry data of the boom 161 indicates a boom top position ($x_{am}$, $y_{am}$, and $z_{am}$) in the boom coordinate system that is a local coordinate system. The boom coordinate system is a coordinate system configured by an $X_{bm}$ axis extending in a longitudinal direction, a $Y_{bm}$ axis extending in a direction in which the pin extends, and a $Z_{bm}$ axis orthogonal to the $X_{bm}$ axis and the $Y_{bm}$ axis, with the position of the pin that connects the boom 161 and the swing body 140 as a reference. The position of the boom top is the position of the pin that connects the boom 161 and the arm 162. The boom top is one of the points of the outer shell of the work machine 100.

The geometry data of the arm 162 indicates the arm top position ($x_{bk}$, $y_{bk}$, and $z_{bk}$) in the arm coordinate system that is a local coordinate system. The arm coordinate system is a coordinate system configured by an $X_{am}$ axis extending in a longitudinal direction, a $Y_{am}$ axis extending in a direction in which the pin extends, and a $Z_{am}$ axis orthogonal to the $X_{am}$ axis and the $Y_{am}$ axis, with the position of the pin that connects the arm 162 and the boom 161 as a reference. The position of the arm top is the position of the pin that connects the arm 162 and the bucket 163. The arm top is one of the points of the outer shell of the work machine 100.

The geometry data of the bucket 163 indicates the position ($x_{ed}$, $y_{ed}$, and $z_{ed}$) of the teeth of the bucket 163 in the bucket coordinate system that is the local coordinate system. The teeth is one of the points of the outer shell of the work machine 100. The bucket coordinate system is a coordinate system configured by an $X_{bk}$ axis extending in a direction of the teeth, a $Y_{bk}$ axis extending in a direction in which the pin extends, and a $Z_{bk}$ axis orthogonal to the $X_{bk}$ axis and the $Y_{bk}$ axis, with the position of the pin that connects the bucket 163 and the arm 162 as a reference.

The position specifying unit 215 generates a boom-vehicle body conversion matrix ${T^{bm}}_{sb}$ for the conversion from the boom coordinate system to the vehicle body coordinate system by the following Formula (1) based on the measurement value of a boom angle $\theta_{bm}$ acquired by the measurement value acquisition unit 214 and the geometry data of the swing body 140. The boom-vehicle body conversion matrix ${T^{bm}}_{sb}$ is a matrix that performs rotation by the boom angle $\theta_{bm}$ around the $Y_{bm}$ axis and performs translation by a deviation ($x_{bm}$, $y_{bm}$, and $z_{bm}$) between the origin of the vehicle body coordinate system and the origin of the boom coordinate system.

In addition, the position specifying unit 215 obtains the position of the boom top in the vehicle body coordinate system by obtaining the product of the position of the boom top in the boom coordinate system indicated by the geometry data of the boom 161 and the boom-vehicle body conversion matrix $T^{bm}_{sb}$.

$$T^{bm}_{sb} = \begin{bmatrix} \cos\theta_{bm} & 0 & \sin\theta_{bm} & x_{bm} \\ 0 & 1 & 0 & y_{bm} \\ -\sin\theta_{bm} & 0 & \cos\theta_{bm} & z_{bm} \\ 0 & 0 & 0 & 1 \end{bmatrix} \quad (1)$$

The position specifying unit 215 generates an arm-boom conversion matrix $T^{am}_{bm}$ for the conversion from the arm coordinate system into the boom coordinate system by the following Formula (2) based on the measurement value of the arm angle $\theta_{am}$ acquired by the measurement value acquisition unit 214 and the geometry data of the boom 161. The arm-boom conversion matrix $T^{am}_{bm}$ is a matrix that performs rotation by the arm angle $\theta_{am}$ around the $Y_{am}$ axis and performs translation by a deviation ($x_{am}$, $y_{am}$, and $z_{am}$) between the origin of the boom coordinate system and the origin of the arm coordinate system. In addition, the position specifying unit 215 generates an arm-vehicle body conversion matrix $T^{am}_{sb}$ for the conversion from the arm coordinate system into the vehicle body coordinate system by obtaining the product of the boom-vehicle body conversion matrix $T^{bm}_{sb}$ and the arm-boom conversion matrix $T^{am}_{bm}$. In addition, the position specifying unit 215 obtains the position of the arm top in the vehicle body coordinate system by obtaining the product of the position of the arm top in the arm coordinate system indicated by the geometry data of the arm 162 and the arm-vehicle body conversion matrix $T^{am}_{sb}$.

$$T^{am}_{bm} = \begin{bmatrix} \cos\theta_{am} & 0 & \sin\theta_{am} & x_{am} \\ 0 & 1 & 0 & y_{am} \\ -\sin\theta_{am} & 0 & \cos\theta_{am} & z_{am} \\ 0 & 0 & 0 & 1 \end{bmatrix} \quad (2)$$

The position specifying unit 215 generates a bucket-arm conversion matrix $T^{bk}_{am}$ for the conversion from the bucket coordinate system into the arm coordinate system by the following Formula (3) based on the measurement value of a bucket angle $\theta_{bk}$ acquired by the measurement value acquisition unit 214 and the geometry data of the arm 162. The bucket-arm conversion matrix $T^{bk}_{am}$ is a matrix that performs rotation by the bucket angle $\theta_{bk}$ around the $Y_{bk}$ axis and performs translation by a deviation ($x_{bk}$, $y_{bk}$, and $z_{bk}$) between the origin of the arm coordinate system and the origin of the bucket coordinate system. In addition, the position specifying unit 215 generates a bucket-vehicle body conversion matrix $T^{bk}_{sb}$ for the conversion from the bucket coordinate system into the vehicle body coordinate system by obtaining the product of the arm-vehicle body conversion matrix $T^{am}_{sb}$ and the bucket-arm conversion matrix $T^{bk}_{am}$.

$$T^{bk}_{am} = \begin{bmatrix} \cos\theta_{bk} & 0 & \sin\theta_{bk} & x_{bk} \\ 0 & 1 & 0 & y_{bk} \\ -\sin\theta_{bk} & 0 & \cos\theta_{bk} & z_{bk} \\ 0 & 0 & 0 & 1 \end{bmatrix} \quad (3)$$

The position specifying unit 215 obtains the position of the teeth of the bucket 163 in the vehicle body coordinate system by obtaining the product of the position of the teeth in the bucket coordinate system indicated by the geometry data of the bucket 163 and the bucket-vehicle body conversion matrix $T^{bk}_{sb}$.

Control Method of Work Machine 100

Hereinafter, a control method of the work machine 100 according to the first embodiment will be described.

First, the operator of the work machine 100 operates the monitor device 142 and sets the virtual wall.

Setting of Virtual Wall

When the input unit 212 receives a virtual wall setting instruction from the monitor device 142, the display control unit 213 causes a selection screen for the type of virtual wall to be set, to be displayed on the monitor device 142. There are five types of virtual walls that can be set by the control device 200, namely, a front wall, a left wall, a right wall, an upper wall, and a lower wall. The front wall, the left wall, and the right wall are wall surfaces extending in the vertical direction. The upper wall and the lower wall are wall surfaces extending in the horizontal direction.

(Setting of Front Wall)

Figure 5:
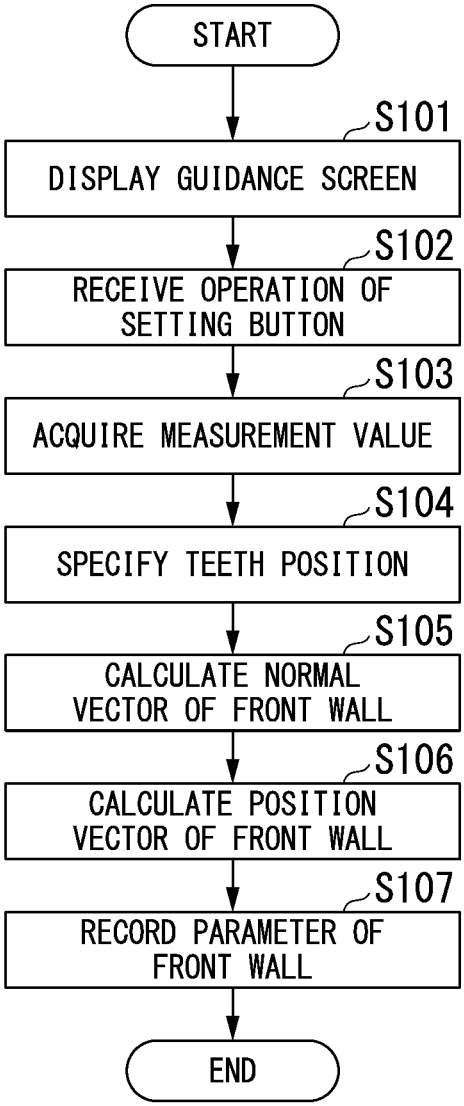
FIG. 5 is a flowchart showing a method of setting a front wall according to the first embodiment.

FIG. 5 is a flowchart showing a method of setting the front wall according to the first embodiment.

When the input unit 212 receives a front wall setting instruction from the monitor device 142, the display control unit 213 causes a guidance screen including a setting button to be displayed on the monitor device 142 (step S101). On the guidance screen, the instruction to move the teeth of the bucket 163 to the point at which the front wall is to be set and operate the setting button is displayed. The operator operates the work machine 100, moves the teeth of the bucket 163 to a desired position, and then operates the setting button. The input unit 212 receives the operation of the setting button from the monitor device 142 (step S102).

The measurement value acquisition unit 214 acquires the measurement values of the inclination measurer 101, the swing angle sensor 102, the boom angle sensor 103, the arm angle sensor 104, the bucket angle sensor 105, and the payload meter 106 at the time when the setting button is operated (step S103). The position specifying unit 215 specifies the position of the teeth of the bucket 163 in the vehicle body coordinate system based on the acquired measurement value (step S104).

The generation unit 216 calculates the parameter of the front wall extending in the vertical direction based on the roll angle and the pitch angle acquired from the inclination measurer 101 in the step S103 and the position of the teeth obtained in the step S104. The virtual wall is represented by a normal vector indicating a normal direction of the virtual wall and a position vector indicating the position of a point through which the virtual wall passes. The generation unit 216 obtains a normal vector by rotating a vector in which the value of the $X_{sb}$ axis is −1, the value of the $Y_{sb}$ axis is 0, and the value of the $Z_{sb}$ axis is 0 only by the roll angle and the pitch angle (step S105). In addition, the generation unit 216 sets the vector indicating the position of the teeth obtained in the step S104 as a position vector (step S106). The generation unit 216 records the generated parameter of the front wall in the main memory 230 (step S107). Incidentally, in a case where the parameter of the front wall has already been recorded in the main memory 230, the old parameter is overwritten with a new parameter.

(Setting of Right Wall and Left Wall)

Figure 6:
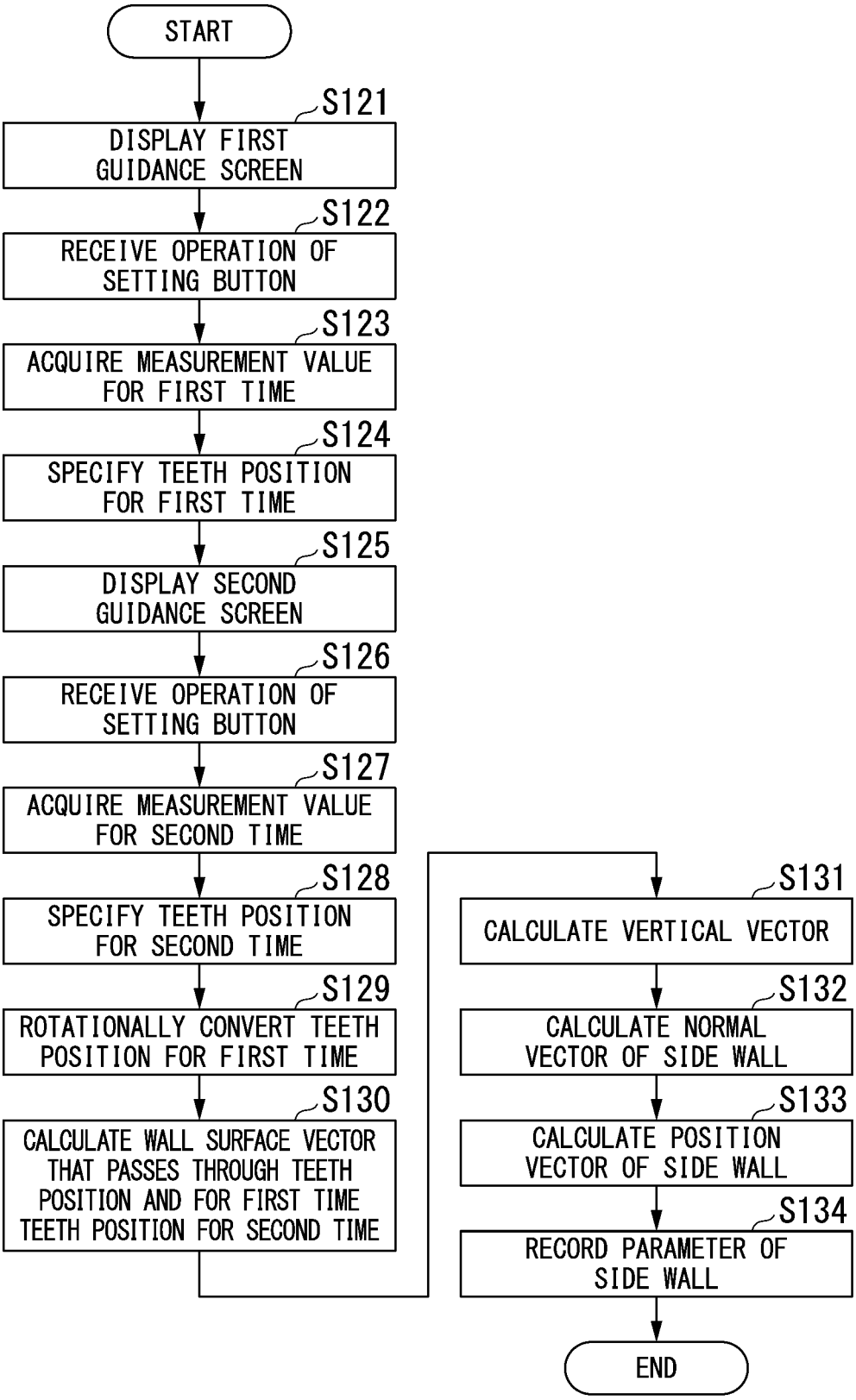
FIG. 6 is a flowchart showing a method of setting a side wall according to the first embodiment.

FIG. 6 is a flowchart showing a method of setting the side wall according to the first embodiment.

When the input unit 212 receives a setting instruction of the right wall or the left wall from the monitor device 142, the display control unit 213 causes a first guidance screen including a setting button to be displayed on the monitor device 142 (step S121). On the guidance screen, the instruction to move the teeth of the bucket 163 to the point at which the right wall or the left wall is to be set and operate the setting button is displayed. The operator operates the work machine 100, moves the teeth of the bucket 163 to a desired position, and then operates the setting button. The input unit 212 receives the operation of the setting button from the monitor device 142 (step S122).

The measurement value acquisition unit 214 acquires the measurement values of the inclination measurer 101, the swing angle sensor 102, the boom angle sensor 103, the arm angle sensor 104, the bucket angle sensor 105, and the payload meter 106 at the time when the setting button is operated (step S123). The position specifying unit 215 specifies the position (position of the teeth for a first time) of the teeth of the bucket 163 in the vehicle body coordinate system based on the acquired measurement value (step S124). The position specifying unit 215 temporarily records the specified teeth position, and the roll angle, the pitch angle, and the yaw angle acquired in the step S123 in the main memory 230.

Next, the display control unit 213 causes a second guidance screen including the setting button to be displayed on the monitor device 142 (step S125). On the guidance screen, the instruction to move the teeth of the bucket 163 to the point at which the right wall or the left wall is to be set and operate the setting button is displayed. The operator operates the work machine 100, moves the teeth of the bucket 163 to a position different from the position set in the step S122, and then operates the setting button. The input unit 212 receives the operation of the setting button from the monitor device 142 (step S126).

The measurement value acquisition unit 214 acquires the measurement values of the inclination measurer 101, the swing angle sensor 102, the boom angle sensor 103, the arm angle sensor 104, the bucket angle sensor 105, and the payload meter 106 at the time when the setting button is operated for a second time (step S127). The position specifying unit 215 specifies the position (position of the teeth for the second time) of the teeth of the bucket 163 in the vehicle body coordinate system based on the acquired measurement value (step S128).

The posture of the work machine 100 when the position of the teeth for the first time is measured is different from the posture of the work machine 100 when the position of the teeth for the second time is measured. Therefore, the rotation conversion unit 217 rotates the position of the teeth for the first time recorded in the main memory 230 based on the position of the teeth for the first time, the roll angle, the pitch angle, and the yaw angle, and the roll angle, the pitch angle, and the yaw angle when the position of the teeth for the second time is measured (step S129). As a result, the rotation conversion unit 217 can convert the position of the teeth for the first time into the position in the vehicle body coordinate system at the current time point.

The generation unit 216 calculates, as the wall surface vector, a difference between the vector indicating the teeth for the first time converted in the step S129 and the vector indicating the position of the teeth for the second time obtained in the step S128 (step S130). The wall surface vector is a vector along the wall surface of the virtual wall and is a vector that passes through the position of the first teeth and the position of the second teeth. Next, the generation unit 216 calculates a vertical vector facing the vertical direction based on the roll angle and the pitch angle when the position of the teeth for the second time is measured (step S131). The generation unit 216 calculates a normal vector by obtaining an outer product of the vector calculated in the step S130 and the vertical vector (step S132). In addition, the generation unit 216 obtains a position vector based on the position of the teeth for the second time acquired in the step S128 (step S133). The generation unit 216 records the generated parameter of the left wall or the right wall in the main memory 230 (step S134). Incidentally, in a case where the parameter of the left wall or the right wall has already been recorded in the main memory 230, the old parameter is overwritten with a new parameter.

(Setting of Upper Wall)

Figure 7:
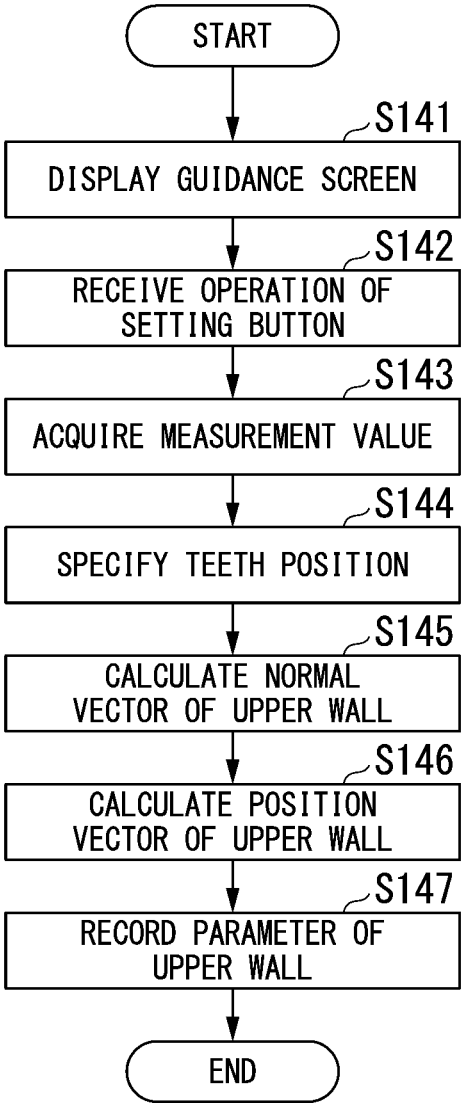
FIG. 7 is a flowchart showing a method of setting an upper wall according to the first embodiment.

FIG. 7 is a flowchart showing a method of setting the upper wall according to the first embodiment.

When the input unit 212 receives an upper wall setting instruction from the monitor device 142, the display control unit 213 causes a guidance screen including a setting button to be displayed on the monitor device 142 (step S141). On the guidance screen, the instruction to move the teeth of the bucket 163 to the point at which the upper wall is to be set and operate the setting button is displayed. The operator operates the work machine 100, moves the teeth of the bucket 163 to a desired position, and then operates the setting button. The input unit 212 receives the operation of the setting button from the monitor device 142 (step S142).

The measurement value acquisition unit 214 acquires the measurement values of the inclination measurer 101, the swing angle sensor 102, the boom angle sensor 103, the arm angle sensor 104, the bucket angle sensor 105, and the payload meter 106 at the time when the setting button is operated (step S143). The position specifying unit 215 specifies the position of the teeth of the bucket 163 in the vehicle body coordinate system based on the acquired measurement value (step S144).

The generation unit 216 calculates the parameter of the upper wall extending in the horizontal direction based on the roll angle and the pitch angle acquired from the inclination measurer 101 in the step S143 and the position of the teeth obtained in the step S144. The generation unit 216 obtains a normal vector by rotating a vector in which the value of the $X_{sb}$ axis is 0, the value of the $Y_{sb}$ axis is 0, and the value of the $Z_{sb}$ axis is −1 only by the roll angle and the pitch angle (step S145). In addition, the generation unit 216 obtains a position vector based on the position of the teeth obtained in the step S144 (step S146). The generation unit 216 records the generated parameter of the upper wall in the main memory 230 (step S147). Incidentally, in a case where the parameter of the upper wall has already been recorded in the main memory 230, the old parameter is overwritten with a new parameter.

(Setting of Lower Wall)

Figure 8:
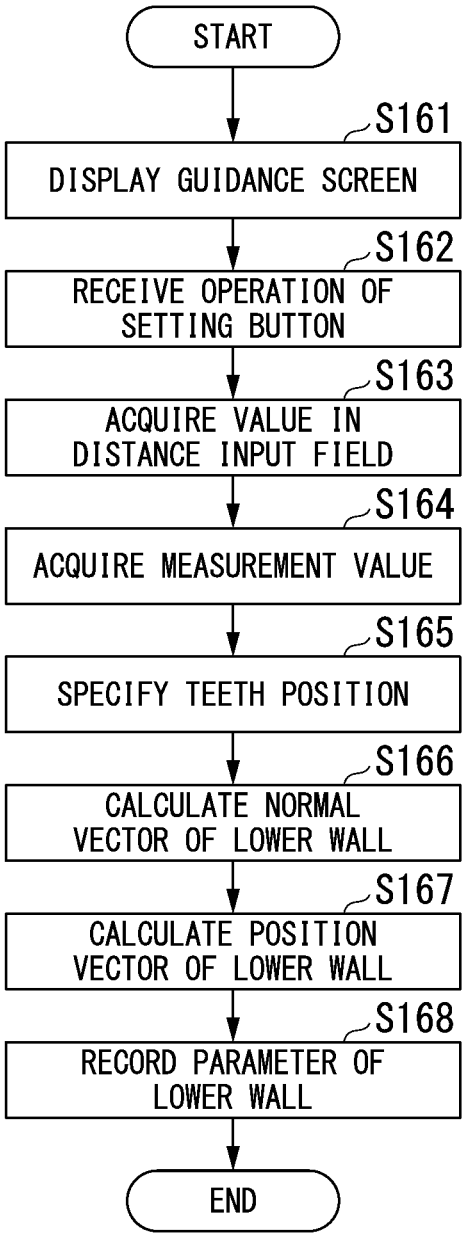
FIG. 8 is a flowchart showing a method of setting a lower wall according to the first embodiment.

FIG. 8 is a flowchart showing a method of setting the lower wall according to the first embodiment.

When the input unit 212 receives a lower wall setting instruction from the monitor device 142, the display control unit 213 causes a guidance screen including a distance input field and a setting button to be displayed on the monitor device 142 (step S161). On the guidance screen, the instruction to move the teeth of the bucket 163 above the point at which the lower wall is to be set, input a distance from the teeth to the lower wall in the distance input field, and operate the setting button, is displayed. In the distance input field, 0 meters is input as an initial value. The operator operates the work machine 100, moves the teeth of the bucket 163 to a desired position, and then operates the setting button. The input unit 212 receives an input into the distance input field and an operation of the setting button from the monitor device 142 (step S162). The input unit 212 acquires the value in the distance input field at the time when the setting button is operated (step S163).

The measurement value acquisition unit 214 acquires the measurement values of the inclination measurer 101, the swing angle sensor 102, the boom angle sensor 103, the arm angle sensor 104, the bucket angle sensor 105, and the payload meter 106 at the time when the setting button is operated (step S164). The position specifying unit 215 specifies the position of the teeth of the bucket 163 in the vehicle body coordinate system based on the acquired measurement value (step S165).

The generation unit 216 calculates the parameter of the lower wall extending in the horizontal direction based on the roll angle and the pitch angle acquired from the inclination measurer 101 in the step S164, the position of the teeth obtained in the step S165, and the distance acquired in the step S163. The generation unit 216 obtains a normal vector by rotating a vector in which the value of the $X_{sb}$ axis is 0, the value of the $Y_{sb}$ axis is 0, and the value of the $Z_{sb}$ axis is 1 only by the roll angle and the pitch angle (step S166). In addition, the generation unit 216 obtains a position vector by obtaining a sum of the vector indicating the position of the teeth obtained in the step S165 and a depth vector obtained by multiplying the normal vector by the distance (step S167). The generation unit 216 records the generated parameter of the lower wall in the main memory 230 (step S168). Incidentally, in a case where the parameter of the lower wall has already been recorded in the main memory 230, the old parameter is overwritten with a new parameter.

Update and Intervention Control of Virtual Wall

The work machine 100 can perform work within a range that the work equipment 160 reaches by swinging the swing body 140. Therefore, an operator usually swings the work machine 100 when work such as excavation is performed. Since the vehicle body coordinate system has the swing body 140 as a reference, the vehicle body coordinate system rotates following the swing of the work machine 100 when viewed from the viewpoint of the global coordinate system. When the virtual wall set in the vehicle body coordinate system rotates following the swing of the work machine 100, the right wall and the left wall do not interfere with the work machine 100 and have no significance. For example, when the right wall is set on the right side of the swing body 140, the right wall is always maintained on the right side of the swing body 140 and does not interfere with the work machine 100, regardless of how the swing body 140 is swung. In addition, when the front wall rotates following the swing of the work machine 100, the front wall acts as an annular wall instead of a planar wall, and thus does not function as a virtual wall along the wall surface of a building.

Therefore, the control device 200 according to the first embodiment performs rotation conversion processing of the virtual wall to maintain the position of the virtual wall in the global coordinate system before and after the work machine 100 swings.

Figure 9:
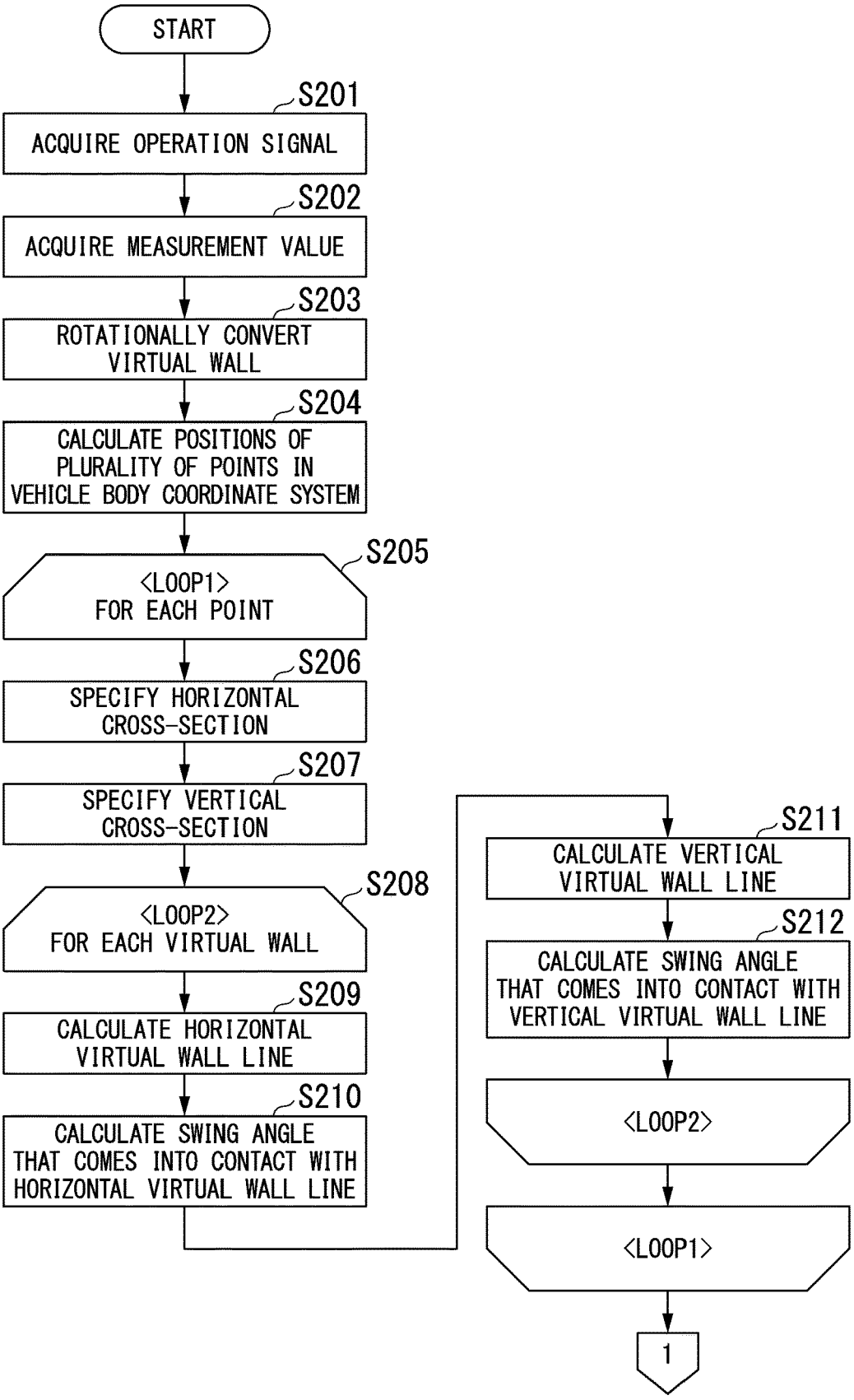
FIG. 9 is a flowchart showing an update and intervention control of the virtual wall set in the first embodiment.
Figure 10:
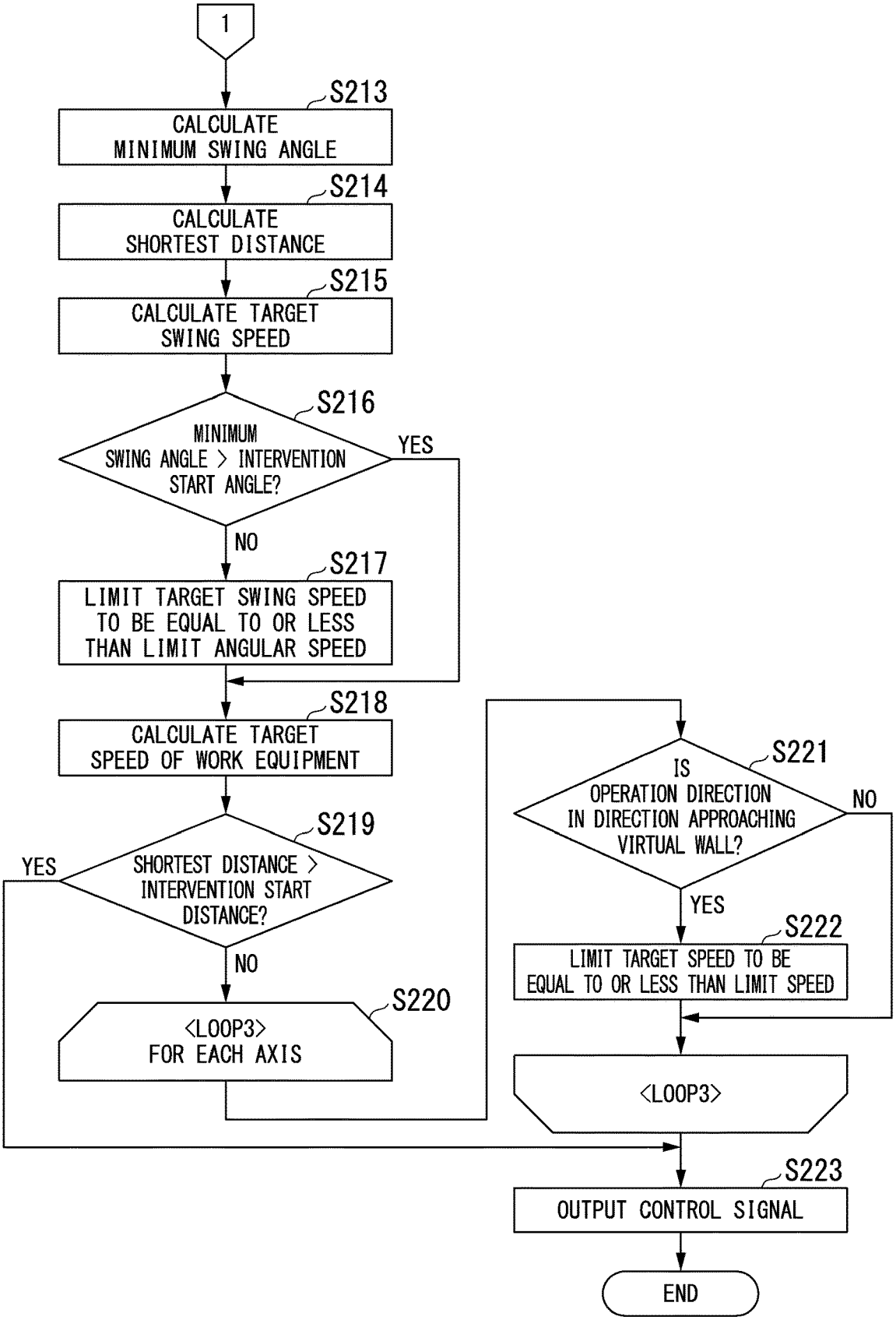
FIG. 10 is a flowchart showing the update and intervention control of the virtual wall set in the first embodiment.

FIGS. 9 and 10 are flowcharts showing the update and intervention control of the virtual wall set in the first embodiment. When the operator of the work machine 100 sets at least one virtual wall by the operation of the monitor device 142, the control device 200 starts the following control.

The operation amount acquisition unit 211 acquires operation signals of the boom 161, the arm 162, the bucket 163, and the swing body 140 from the operation device 141 (step S201). The measurement value acquisition unit 214 acquires the measurement values of the inclination measurer 101, the swing angle sensor 102, the boom angle sensor 103, the arm angle sensor 104, the bucket angle sensor 105, and the payload meter 106 (step S202).

The rotation conversion unit 217 rotationally converts each of one or more virtual walls stored in the main memory 230 based on the roll angle, the pitch angle, and the yaw angle of the swing body 140 acquired from the inclination measurer 101 in the step S202, and update (step S203).

The position specifying unit 215 calculates the positions of the plurality of points on the outer shell of the work machine 100 in the vehicle body coordinate system based on the measurement value acquired in the step S202 (step S204). The intervention determination unit 218 selects the points specified by the position specifying unit 215 one by one (step S205), and executes the processing of a step S206 to a step S212 below.

The intervention determination unit 218 specifies a cross-section that passes through the point selected in the step S205 and is parallel to the $X_{sb}$-$Y_{sb}$ plane of the vehicle body coordinate system (step S206). In addition, the intervention determination unit 218 specifies a cross-section that passes through the point selected in the step S205 and is parallel to the $X_{sb}$-$Z_{sb}$ plane of the vehicle body coordinate system (step S207).

The intervention determination unit 218 selects one or more virtual walls set in the main memory 230 one by one (step S208), and executes the processing from a step S209 to a step S212 below.

The intervention determination unit 218 calculates an intersection line between the cross-section generated in the step S206 and the virtual wall selected in the step S208 as a horizontal virtual wall line (step S209). Incidentally, the horizontal virtual wall line may not exist depending on the positional relationship between the cross-section generated in the step S206 and the virtual wall. When the horizontal virtual wall line exists, the intervention determination unit 218 obtains the swing angle at which the point selected in the step S205 comes into contact with the horizontal virtual wall line calculated in the step S209 for each of the right swing and the left swing (step S210). For example, the intervention determination unit 218 calculates an intersection point between the circle passing through the point selected in the step S205 with the swing center as the center and the horizontal virtual wall line, and obtains an angle between a line segment extending from the swing center to the point selected in the step S205 and the line segment extending from the swing center to the intersection point. Incidentally, the intersection point may not exist depending on the positional relationship between the point selected in the step S205 and the horizontal virtual wall line.

In addition, the intervention determination unit 218 calculates an intersection line between the cross-section generated in the step S207 and the virtual wall selected in the step S208 as the vertical virtual wall line (step S211). Incidentally, the vertical virtual wall line may not exist depending on the positional relationship between the cross-section generated in the step S207 and the virtual wall. When the vertical virtual wall line exists, the intervention determination unit 218 obtains a distance between the point selected in the step S205 and the vertical virtual wall line calculated in the step S211 (step S212).

The intervention determination unit 218 calculates a minimum swing angle at which at least one of a plurality of points is in contact with at least one virtual wall for each of the right swing and the left swing, based on the swing angle for each virtual wall at each point on the work machine 100 obtained in the step S210 (step S213).

The intervention determination unit 218 calculates the shortest distance between the work equipment 160 and the virtual wall based on a distance to each virtual wall at each point on the work machine 100 obtained in the step S212 (step S214).

The intervention determination unit 218 calculates the swing direction and the target swing speed based on the operation signal of the swing body 140 acquired in the step S201 (step S215). The intervention determination unit 218 determines whether or not the minimum swing angle in the swing direction indicated by the operation signal is larger than the intervention start angle (step S216). When the minimum swing angle is larger than the intervention start angle (step S216: YES), the intervention control unit 219 does not perform the intervention control on the swing. On the other hand, when the minimum swing angle is equal to or less than the intervention start angle (step S216: NO), the intervention control unit 219 specifies a limit angular speed from the minimum swing angle based on a predetermined limit angular speed table, and limits the target swing speed of the swing body 140 to a value equal to or less than the limit angular speed (step S217). The limit angular speed table is a function indicating a relationship between the minimum swing angle and the limit angular speed, and is a function in which the smaller the minimum swing angle, the smaller the limit angular speed.

The limit angular speed table may be set to, for example, a deceleration rate at which an operational feeling of the swing body 140 by the operator is not impaired.

The intervention determination unit 218 calculates a target speed of the work equipment 160 based on the operation signals of the boom 161, the arm 162, and the bucket 163 acquired in the step S201 (step S218). Specifically, the intervention determination unit 218 calculates the target speeds of the boom 161, the arm 162, and the bucket 163 based on the operation signals of the boom 161, the arm 162, and the bucket 163 acquired in the step S201. Next, the intervention determination unit 218 determines whether or not the shortest distance calculated in the step S214 is longer than the intervention start distance (step S219). When the shortest distance is longer than the intervention start distance (step S219: YES), the intervention control unit 219 does not perform the intervention control on the work equipment 160. On the other hand, when the shortest distance is equal to or less than the intervention start distance (step S219: NO), the intervention control unit 219 selects each of the axes of the work equipment 160 one by one, and performs the following processing of a step S221 to a step S222 below for the selected axis (step S220). The intervention control unit 219 determines whether or not the operation direction of the selected axis is an operation in a direction approaching the virtual wall (step S221). When the operation direction of the selected axis is not the operation in the direction approaching the virtual wall (step S220: NO), the intervention control unit 219 does not perform the intervention control on the selected axis. On the other hand, when the operation direction of the selected axis is an operation in the direction of approaching the virtual wall (step S220: YES), the intervention control unit 219 specifies a limit speed based on a predetermined limit speed table for the selected axis and limits the target speed to a value equal to or lower than the limit speed (step S222).

The control signal output unit 220 generates a control signal based on the target speeds of the boom 161, the arm 162, and the bucket 163 and the target angular speed of the swing body 140, and outputs the control signal to the control valve 113 (step S223).

Actions and Effects

In this manner, the control device 200 rotationally converts the virtual wall that is defined by the vehicle body coordinate system in association with the swing of the swing body 140, and controls the work machine 100 such that the outer shell of the work machine 100 does not come into contact with the virtual wall. In this manner, the control device 200 can fix an absolute position of the virtual wall by rotating the virtual wall that is defined by the vehicle body coordinate system in association with the swing of the swing body 140. Therefore, the control device 200 can limit the operation of the work machine 100 by the virtual wall of a plane without referring to the global coordinate system. By setting the virtual wall of a plane, entry into a region of the construction site usually partitioned by the plane can be appropriately limited.

In addition, when the control device 200 according to the first embodiment specifies the position of the distal end of the work equipment 160 in the vehicle body coordinate system, and generates the virtual wall at the position of the distal end of the work equipment 160 when a generation instruction of the virtual wall is received. As a result, the operator can easily set the virtual wall by operating the work equipment and inputting the generation instruction. Incidentally, another embodiment is not limited thereto, and for example, the virtual wall may be set by the operator inputting the coordinates of the virtual wall by operating the monitor device 142.

In addition, the control device 200 according to the first embodiment generates the virtual wall extending in the vertical direction or the horizontal direction based on the measurement value of the inclination measurer 101. Generally, a region of a construction site is partitioned along a vertical direction by a wall or a fence. Therefore, by setting the virtual wall to extend in the vertical direction, the entry of the work machine 100 into the region can be appropriately controlled. In addition, since it is general that the work machine 100 is controlled not to exceed the lowest point of an obstacle on an upper side, such as a suspension line or a ceiling, the virtual wall is set to extend in the horizontal direction, so that the lowest point control can be appropriately performed.

Another Embodiment

The embodiments have been described above in detail with reference to the drawings: however, the specific configurations are not limited to the above-described configurations, and various design changes or the like can be made. That is, in another embodiment, the order of the above-described processing may be appropriately changed. In addition, some of the processing may be executed in parallel.

The control device 200 according to the above-described embodiment may be configured by a single computer, or the configuration of the control device 200 may be disposed to be divided into a plurality of computers, and the plurality of computers may function as the control device 200 by cooperating with each other. In this case, a part of the computers constituting the control device 200 may be mounted inside the work machine 100, and another computer may be provided outside the work machine 100.

The control device 200 according to another embodiment determines a limit angular speed based on a predetermined limit angular speed table when the intervention control of the swing operation is performed, but is not limited thereto. The moment of inertia of the work machine 100 changes depending on the posture of the work equipment 160 and the weight of a load loaded on the bucket 163. Therefore, the intervention control unit 219 may determine the limit angular speed in view of the change in the moment of inertia. For example, the position specifying unit 215 can specify the position of the center of gravity of each component in the vehicle body coordinate system by storing the position of the center of gravity of each component in the geometry data. The intervention control unit 219 can obtain the position of the center of gravity of the work equipment 160 based on a vector obtained by multiplying each of the positions of the centers of gravity by a known weight and further a vector obtained by multiplying the position of the bucket 163 by the weight indicated by the measurement value of the payload meter 106. As a result, the intervention control unit 219 can determine the limit angular speed in view of the change in the moment of inertia by multiplying the limit angular speed obtained from the limit angular speed table by a coefficient corresponding to an inertia ratio calculated from the position of the center of gravity and the weight of the work equipment 160.

Figure 11:
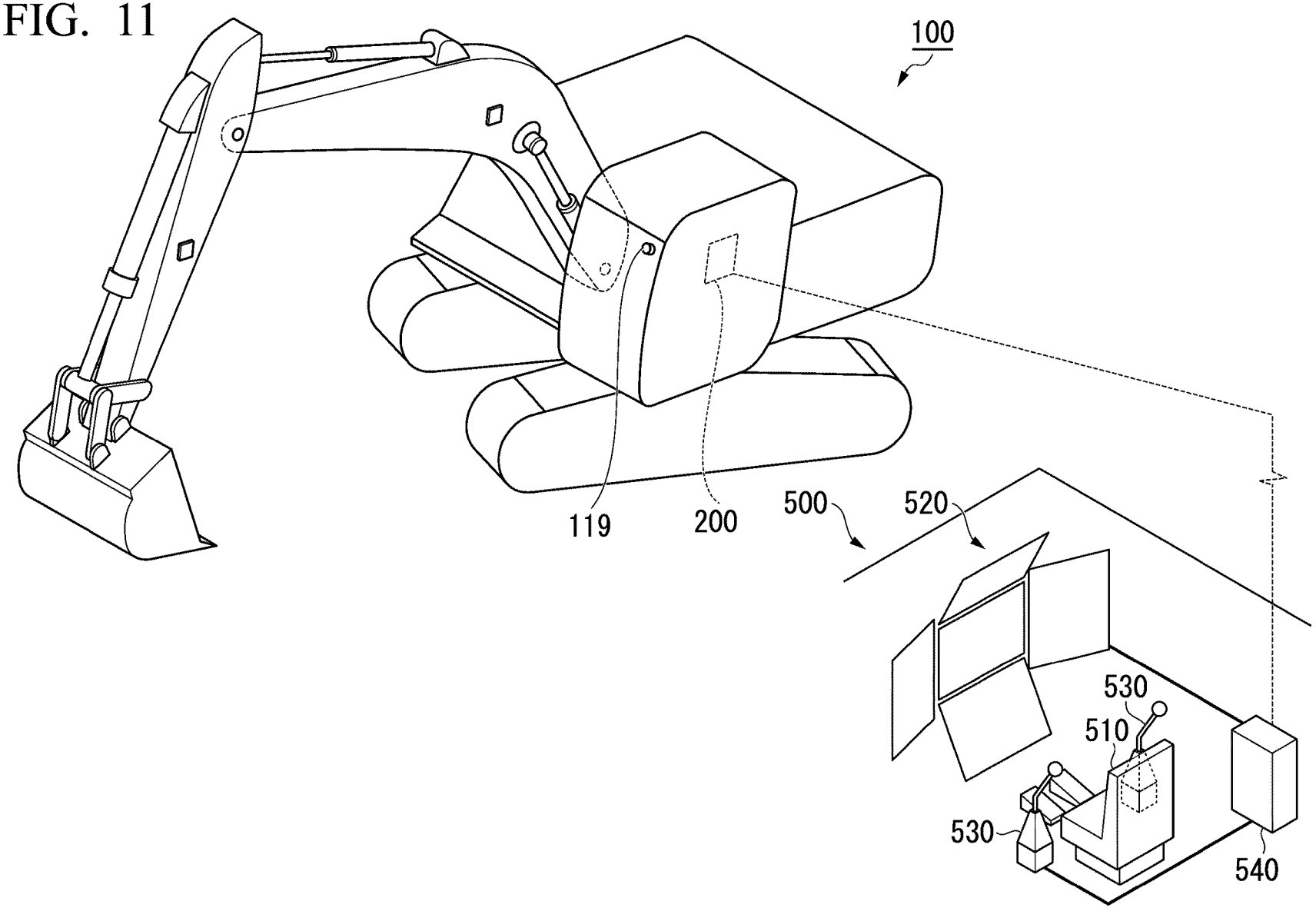
FIG. 11 is a schematic diagram showing a configuration of a work system according to another embodiment.

The work machine 100 according to the first embodiment is operated by an operator who boards the cab 180, but the work machine 100 according to another embodiment is not limited thereto. FIG. 11 is a schematic diagram showing a configuration of a work system according to another embodiment. The work machine 100 according to another embodiment may be operated by a remote operation device 500 as shown in FIG. 10. The work machine 100 that is remotely operated further includes an imaging device 119 in addition to the configuration of the first embodiment, and the control device 200 transmits an image captured by the imaging device 119 to the remote operation device 500 in real time. The remote operation device 500 includes a driver seat 510, a display 520, an operation device 530, and a remote operation server 540. The remote operation server 540 displays the image received from the work machine 100 on the display 520. As a result, the operator can recognize the surrounding situation of the remote work machine 100. In addition, the remote operation server 540 transmits an operation signal of the operation device 530 by the operator to the work machine 100 via a network. The remote operation server 540 executes at least a part of the functions of the control device 200 according to the first embodiment. That is, in the work system including the remote operation server 540, the control device 200 and the remote operation server 540 constitute the work system.

Although the bucket 163 is attached to the work equipment 160 according to the first embodiment, the present invention is not limited thereto. For example, the work equipment 160 according to another embodiment may include other work equipment, such as a breaker or a grapple, instead of the bucket. In addition, work equipment such as the bucket 163 according to another embodiment may be attached to the distal end portion of the arm 162 via a tilt attachment or a tilt-rotate attachment.

INDUSTRIAL APPLICABILITY

According to at least one of the above aspects, an operation of the work machine can be limited by a virtual wall of a plane without referring to a global coordinate system.

What is claimed is:

1. A control system that controls a work machine including a swing body configured to swing, the control system comprising:

a processor, wherein the processor generates a virtual wall that is defined by a plane on a vehicle body coordinate system of which origin is a representative point of the swing body, rotationally converts the virtual wall around the origin of the vehicle body coordinate system in association with a swing of the swing body, specifies a position of an outer shell of the work machine in the vehicle body coordinate system, and controls the work machine such that the outer shell does not come into contact with the virtual wall.

2. The control system according to claim 1, wherein the processor acquires a measurement value from an inclination measurer that measures a posture of the swing body, calculates an amount of change in the posture caused by the swing of the swing body based on the measurement value, and rotationally converts the virtual wall based on the amount of change in the posture.

3. The control system according to claim 1, wherein the processor acquires a measurement value from an inclination measurer that measures a posture of the swing body, and generates the virtual wall extending in a vertical direction or a horizontal direction based on the measurement value.

4. The control system according to claim 1, wherein the work machine includes work equipment provided on the swing body, and the processor specifies a position of a distal end of the work equipment, and generates the virtual wall at the position of the distal end of the work equipment when a generation instruction of the virtual wall is received.

5. The control system according to claim 1, wherein the processor specifies positions of a plurality of points on the outer shell of the work machine, obtains a minimum swing angle at which at least one of the plurality of points comes into contact with the virtual wall when the swing body is swung, based on the positions of the plurality of points, and controls the swing of the swing body based on the minimum swing angle.

6. A control method of a work machine including a swing body configured to swing, the control method comprising:

a step of generating a virtual wall that is defined by a plane on a vehicle body coordinate system of which origin is a representative point of the swing body;

a step of rotationally converting the virtual wall around the origin of the vehicle body coordinate system in association with a swing of the swing body;

a step of specifying a position of an outer shell of the work machine in the vehicle body coordinate system; and a step of controlling the work machine such that the outer shell does not come into contact with the virtual wall.

7. A control program causing a computer that controls a work machine including a swing body configured to swing, to execute:

a step of generating a virtual wall that is defined by a plane on a vehicle body coordinate system of which origin is a representative point of the swing body;

a step of rotationally converting the virtual wall around the origin of the vehicle body coordinate system in association with a swing of the swing body;

a step of specifying a position of an outer shell of the work machine in the vehicle body coordinate system; and a step of controlling the work machine such that the outer shell does not come into contact with the virtual wall.

* * * * *